US007938349B2

(12) United States Patent
Neumann et al.

(10) Patent No.: US 7,938,349 B2
(45) Date of Patent: May 10, 2011

(54) ROLLER MILL

(75) Inventors: Christian Neumann, Beckum (DE); Franz-Josef Zurhove, Bad Iburg (DE)

(73) Assignee: Polysius AG, Beckum (DE)

( * ) Notice: Subject to any disclaimer, the term of this patent is extended or adjusted under 35 U.S.C. 154(b) by 108 days.

(21) Appl. No.: 12/305,033

(22) PCT Filed: Jun. 20, 2007

(86) PCT No.: PCT/EP2007/056165

§ 371 (c)(1),
(2), (4) Date: Dec. 16, 2008

(87) PCT Pub. No.: WO2007/147860

PCT Pub. Date: Dec. 27, 2007

(65) Prior Publication Data

US 2009/0200409 A1 Aug. 13, 2009

(30) Foreign Application Priority Data

Jun. 21, 2006 (DE) ..... 10 2006 028 547

(51) Int. Cl.
*B02C 15/00* (2006.01)

(52) U.S. Cl. ..... 241/121

(58) Field of Classification Search ..... 241/117–121
See application file for complete search history.

(56) References Cited

FOREIGN PATENT DOCUMENTS

| | | | |
|---|---|---|---|
| DE | 15 07 579 | | 9/1970 |
| DE | 36 42 814 | | 6/1988 |
| JP | 05 007786 | | 1/1993 |
| JP | 5-38460 | * | 2/1993 |

* cited by examiner

*Primary Examiner* — Mark Rosenbaum
(74) *Attorney, Agent, or Firm* — Gifford, Krass, Sprinkle, Anderson & Citkowski, P.C.

(57) ABSTRACT

The invention relates to a roll mill having a grinding plate and at least one grinding roll rolling on the grinding plate, wherein material which is to be comminuted, after being subjected to loading in a gap formed between the grinding plate and grinding roll, is directed away over the periphery of the grinding plate and, furthermore, a stationary accumulating edge, which does not rotate along with the grinding plate, is provided, at least on that side of the grinding roll which is directed towards the periphery of the grinding plate, this accumulating edge forming at least part of an elevation of the periphery of the grinding plate. The elevation of the periphery of the grinding plate here is higher in the region of the grinding rolls than in the region between the grinding rolls, in order to prevent the material which is to be comminuted from escaping radially from the gap formed between the grinding plate and grinding roll.

9 Claims, 2 Drawing Sheets

ROLLER MILL

The invention relates to a roller mill having a grinding table and at least one grinding roller rolling on the grinding table, grinding stock to be crushed being subjected to compaction in a gap formed between the grinding table and the grinding roller, before being led off via the rim of the grinding table.

In order to be able to achieve high throughput capacities for a low power demand relative to the mass, the mill must be operated either at the highest possible grinding table speed or with a smaller interval between the grinding rollers—that is to say with a greater number of grinding rollers. The quiet running of the roller mill is here to be regarded as a limitative factor. In order that the grinding stock cannot escape from the gap between the grinding table and the grinding roller, thereby subjecting it to optimum compaction, a so-called impounding ring is usually provided.

DE-A-36 42 814 discloses roller mill having three grinding rollers, a retaining device being provided between each two grinding rollers in the area of the grinding path, in order to impede the grinding stock on its path from the centre to the rim of the grinding table. This is intended to prevent the ground material leaving the table without being crushed. The impounding edge causes a very high grinding bed to form in the area of the grinding path, which is intended to improve the grinding capacity and quiet running of the mill. The only possible way out to the table rim is in the area of the grinding rollers. This retaining device has the disadvantages, however, that it has no influence on the escape of ground material from the grinding gap and that the roller width is not uniformly and completely charged with grinding stock and therefore does not contribute to the crushing.

DE-A-1 507 579 describes a roller crushing mill, in which a fixed impounding wall, which leads in the direction of rotation of the grinding table up to a grinding gap of a grinding roller and the height of which allows the ground material-gas mixture to flow around, at least at its upper edge, is likewise arranged between the two grinding rollers. The impounding wall has the effect of coarse preliminary screening, because the air flow carries the finer fractions with their greater capacity for suspension around the top and bottom of the impounding wall, whereas the coarse fractions are diverted and returned to the grinding process by the shortest route. This is intended to eliminate the repeated rolling of material in finer fractions.

JP 05 007 786 A discloses a vertical mill having a fixed impounding edge that does not rotate together with the grinding table, the impounding edge extending over the entire circumference of the grinding table rim.

The object of the invention now is to further develop the roller mill in such a way that higher throughput capacities can be achieved for a low power demand relative to the mass.

According to the invention this object is achieved by the features of claim 1.

The roller mill according to the invention has a grinding table and at least one grinding roller rolling on the table, grinding stock to be crushed being subjected to compaction in a gap formed between the grinding table and the grinding roller before being led off via the edge of the grinding table and a fixed impounding edge that does not rotate together with the grinding table furthermore being provided, said edge being provided at least on the side of the grinding roller facing the rim of the grinding table and forming at least a part of an elevation of the rim of the grinding table. The elevation of the rim of the grinding table is in this case higher in the area of the grinding rollers than in the area between the grinding rollers, in order to prevent the ground material escaping radially from the gap formed between the grinding table and the grinding roller.

In contrast to the teaching disclosed in DE-A-36 42 814, in the roller mill according to the invention the ground material is not intended to escape from the grinding gap in the area of the grinding rollers but first to be subjected to full compaction by the grinding rollers. The finish-ground material is then discharged only in an area between the grinding roller that has just crushed the ground material and the next grinding roller. The fact that no ground material or scarcely any can escape in the area of the grinding rollers ensures optimum compaction.

After compaction the crushed material should leave the table as rapidly as possible and be led for screening. Fine fractions are known to have an adverse effect on the stability of the grinding bed and to lead to vibrations. The physical correlation deriving from the available retention time between two crushing processes, with the centrifugal forces and the table contour including a rotary impounding edge and the flow properties of the ground material produces the path curves for the particles and therefore the proportion of the already crushed material which leaves the table, and the proportion which is delivered for subsequent crushing. The retention time and the centrifugal forces are determined by the interval between the grinding rollers and their position, and the rotational speed of the table. The flow characteristics of the ground material vary primarily as a function of the type (grain size, mineralogy, etc.), the fineness and the humidity and can be influenced only to a limited extent. The height of the impounding edge has a marked influence on the path lines. The impounding edge must have a height varying over the circumference, in order to prevent a lateral escape from the crushing zone on the one hand, and to obtain a rapid run-off from the grinding path on the other. In this way higher rotational speeds of the grinding table and hence higher throughput capacities are possible.

Further developments of the invention form the subject matter of the dependent claims.

According to a preferred exemplary embodiment the impounding edge is adjustable in a radial and/or vertical direction. The impounding edge may also have different heights over its length.

It is also feasible to provide an impounding ring rotating together with the grinding table in the area of the rim of the grinding table. In this case the impounding edge in the area of the grinding roller is higher than the impounding ring. This not only makes it possible to maintain a grinding stock bed but also facilitates the run-off of the sufficiently ground material in the area between two grinding rollers.

Further advantages and forms of the invention will be explained in more detail below with reference to the description and the drawing.

In the drawing

Figures 1, 2:
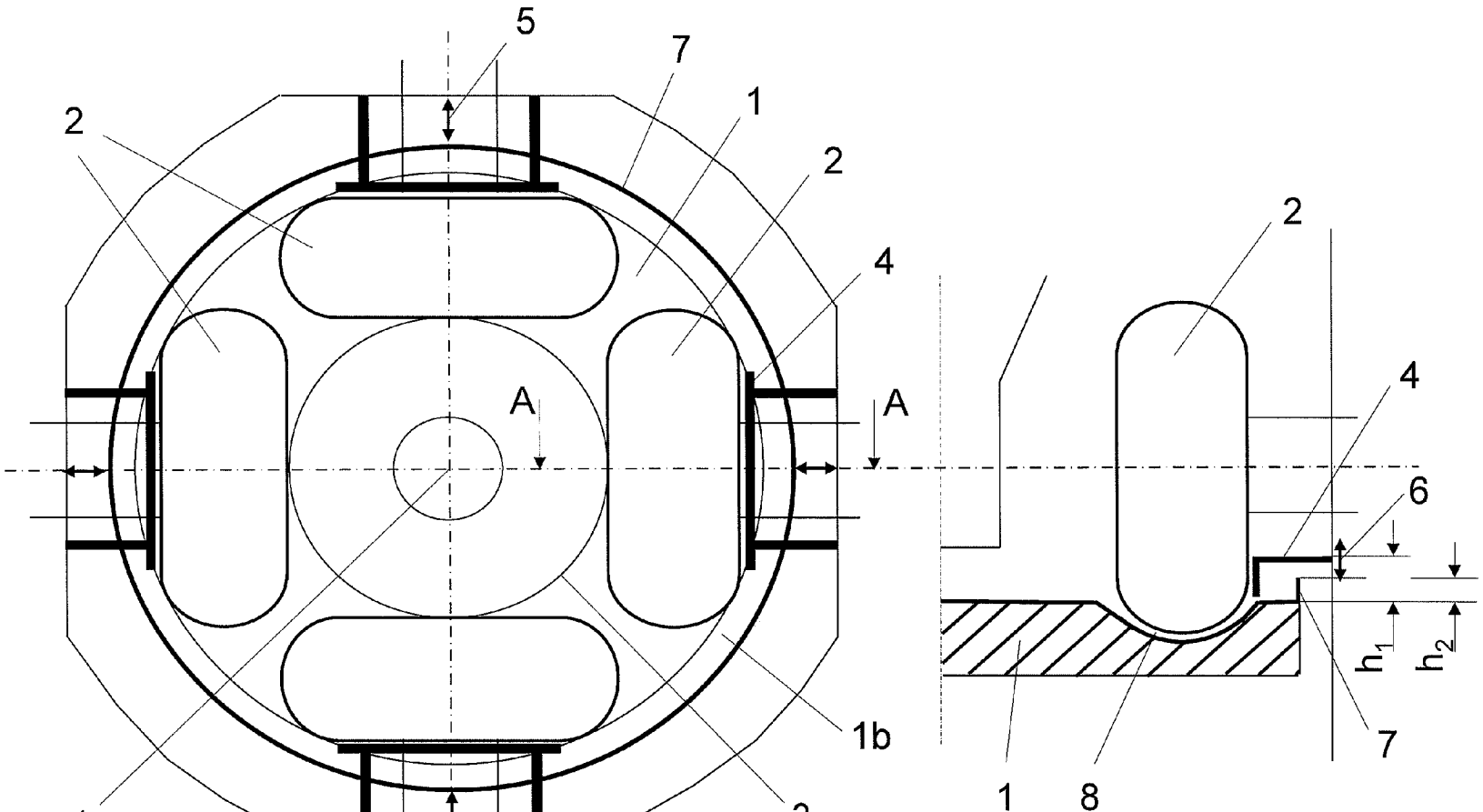
FIG. 1 shows a schematic top view of a roller mill.
FIG. 2 shows a schematic sectional representation along the line A-A in FIG. 1

The roller mill represented in FIGS. 1 and 2 in the main comprises a grinding table 1 and at least one grinding roller 2 rolling on the grinding table. In the exemplary embodiment shown four grinding rollers 2 are represented. It would also be feasible, however, without departing from the scope of the invention, to provide a roller mill with two or six grinding rollers, for example. The grinding table 1 is driven to rotate about a vertical axis 1*a*. The grinding rollers 2 rest under their own weight on the grinding table 1 or they may be subjected to an additional contact pressure by a suitable device.

The grinding stock to be crushed is fed centrally via a feeder 3 onto the rotating grinding table 1 and from there passes outwards under centrifugal force and is engaged by the grinding rollers 2. The actual crushing work takes place in the gap between grinding roller 1 and grinding table 1. In order to prevent the ground material escaping radially from the gap formed between the grinding table and the grinding roller, a fixed impounding edge 4, i.e. an edge not rotating with the grinding table is provided on the side of the grinding roller 2 facing the rim 1*b* of the grinding table 1.

The impounding edge 4 may here be suitably adjustable both in a radial direction (double arrow 5) and in a vertical direction (double arrow 6).

It may furthermore be expedient to provide an impounding ring 7 rotating together with the grinding table 1 at the outer rim 1*a*. In this case the chosen height $h_1$ of the impounding edge 4 (above the grinding table 1) will appropriately be greater than the height $h_2$ of the impounding ring 7. Additional impounding ring elevations known from practical use may obviously also be provided. It is also feasible for the impounding edge to have different heights over its length in the circumferential direction of the grinding table 1.

Figure 3:
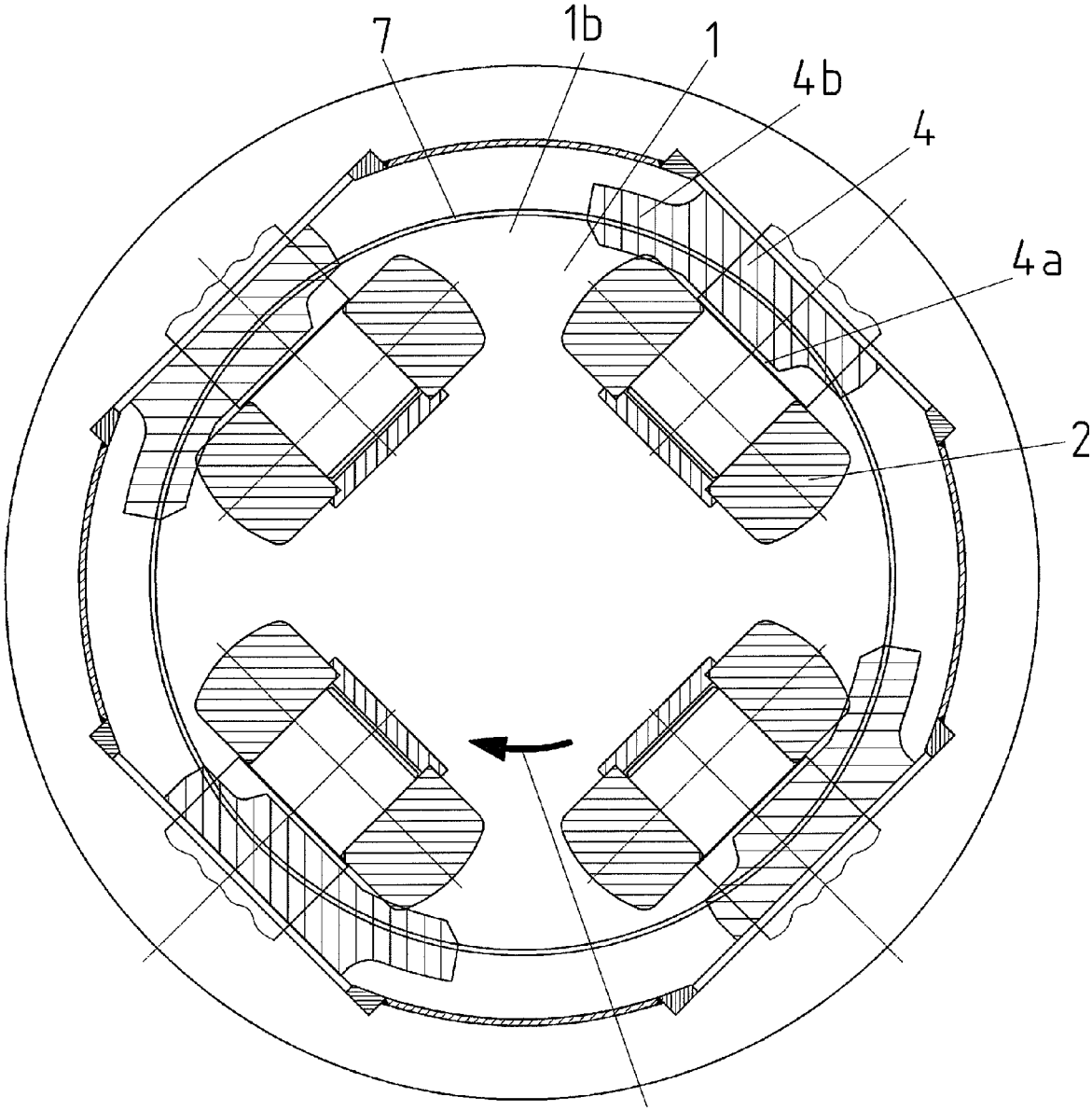
FIG. 3 shows a somewhat more detailed top view of a further roller mill.

FIG. 3 shows a somewhat more detailed top view of the roller mill, illustrating, in particular, one feasible form of the fixed impounding edge 4. In the area of the gap formed between the grinding table and the grinding roller, the adjoining area 4*a* of the impounding edge 4 is arranged substantially parallel to the grinding roller. It is appreciated from FIG. 3 that the adjoining area 4*a* of the impounding edge 4 is also arranged substantially parallel to a side face of the grinding roller. The front area 4*b* of the impounding edge in the direction of rotation 9 of the grinding table 1 is slightly bent or curved and approximately follows the contour of the grinding table rim 1*b*.

After rolling, the ground material that has been sufficiently crushed passes outwards under centrifugal force and is discharged over the rim 1*b* of the grinding table or over the impounding ring 7. The raised impounding edge in the area of the grinding roller 2 ensures that the grinding stock is subjected to sufficient crushing by the grinding roller before it is discharged over the rim of the grinding table 1. In addition, the substantially lower impounding ring 7 or the absence of any such impounding ring ensures, in particular, that the fine material is discharged before it is rolled again. This has a positive effect on the quiet running of the machine, so that the grinding table 1 can be run at higher rotational speeds, thereby achieving a higher throughput capacity.

The invention claimed is:

1. A roller mill having a grinding table and at least one grinding roller rolling on the grinding table, grinding stock to be crushed being subjected to compaction in a gap formed between the grinding table and the grinding roller before being led off via the rim of the grinding table, and a fixed impounding edge that does not rotate together with the grinding table furthermore being provided, said edge being provided at least on the side of the grinding roller facing the rim of the grinding table and forming at least a part of an elevation of the rim of the grinding table, characterized in that the elevation of the rim of the grinding table is higher in the area of the grinding rollers than in the area between the grinding rollers and said impounding edge having an adjoining area arranged substantially parallel to a side face of said at least one grinding roller, in order to prevent the ground material escaping radially from the gap formed between the grinding table and the grinding roller and in order to discharge the finish-ground material only in an area between the at least one grinding roller that has just crushed the ground material and a next grinding roller.

2. The roller mill according to claim 1, characterized in that the impounding edge is adjustable in a radial direction.

3. The roller mill according to claim 1, characterized in that the impounding edge is adjustable in a vertical direction.

4. The roller mill according to claim 1, characterized in that over its length the impounding edge has different heights.

5. The roller mill according to claim 1, characterized in that the impounding edge is of straight design.

6. The roller mill according to claim 1, characterized in that an impounding ring, which rotates together with the grinding table and which also forms a part of the elevation of the rim of the grinding table, is provided in the area of the rim of the grinding table.

7. The roller mill according to claim 6, characterized in that the impounding edge in the area of the grinding roller is higher than the impounding ring.

8. The roller mill according to claim 6, characterized in that impounding ring elevations are additionally provided.

9. The roller mill according to claim 1, characterized in that at least two grinding rollers are provided.

* * * * *